US011464322B1

(12) United States Patent
Nguyen

(10) Patent No.: US 11,464,322 B1
(45) Date of Patent: Oct. 11, 2022

(54) IDENTIFICATION CARD PRESENTATION SYSTEM AND METHOD OF USE

(71) Applicant: Morgan Nguyen, Fort Worth, TX (US)

(72) Inventor: Morgan Nguyen, Fort Worth, TX (US)

( * ) Notice: Subject to any disclaimer, the term of this patent is extended or adjusted under 35 U.S.C. 154(b) by 0 days.

(21) Appl. No.: 17/495,464

(22) Filed: Oct. 6, 2021

(51) Int. Cl.
*G09F 3/16* (2006.01)
*A45F 5/00* (2006.01)

(52) U.S. Cl.
CPC ..... *A45F 5/00* (2013.01); *G09F 3/16* (2013.01); *A45F 2200/055* (2013.01)

(58) Field of Classification Search
CPC ..... A45F 2200/055; G09F 3/16; G09F 3/207; G09F 3/20; G09F 3/06; G09F 3/18; A44C 3/001; A45C 11/182; A45C 11/18; A45C 13/42
USPC ..... 40/1.5
See application file for complete search history.

(56) References Cited

U.S. PATENT DOCUMENTS

| | | | | |
|---|---|---|---|---|
| 4,462,175 | A * | 7/1984 | Romberger | G09F 3/18 40/661 |
| 5,647,099 | A * | 7/1997 | Cohen | A44C 15/003 40/1.5 |
| 6,086,971 | A * | 7/2000 | Haas | G09F 3/14 428/137 |
| 6,516,500 | B2 * | 2/2003 | Ogino | A44B 99/00 24/504 |
| 7,174,607 | B1 * | 2/2007 | Buettell | A45F 5/00 24/499 |
| 8,099,891 | B2 * | 1/2012 | Maier-Hunke | G09F 3/207 40/658 |
| 2004/0045133 | A1 * | 3/2004 | Buettell | A45F 5/02 24/3.12 |
| 2020/0060402 | A1 * | 2/2020 | McCarty | A45F 5/00 |

* cited by examiner

*Primary Examiner* — Adam J Waggenspack
(74) *Attorney, Agent, or Firm* — Leavitt Eldredge Law Firm

(57) ABSTRACT

An identification card presentation system that allows for access to the card while in a holder. The holder allows for the rapid removal of the card should it be needed. The holder has two jaws that close similar to a clamshell to hold the card between them. The inner surfaces have high friction grips to secure the card in the holder. The holder allows for a key ring or other carrying device to be attached so that the identification card is joined to the keys.

2 Claims, 5 Drawing Sheets

IDENTIFICATION CARD PRESENTATION SYSTEM AND METHOD OF USE

BACKGROUND

1. Field of the Invention

The present invention relates generally to identification systems, and more specifically, to an identification card presentation system for securing a badge ID to the person while preserving access to the badge ID for use both inspection and insertion.

2. Description of Related Art

Identification systems are well known in the art and are effective means to verify the identity or a person or organization. For example, identification cards contain an image and data related to a person so that when presented another person can readily verify that the person with the identification card is the person described by the identification card. These identification cards also contain electronic keys and allow access to buildings, computer networks and the like. It is common for employers to require the use of identification cards to ensure that proprietary information remains secure.

These identification cards are commonly carried in a pouch about the neck on a lanyard or secured to the body of the person by a clip.

One of the problems commonly associated with identification cards is its limited efficiency. For example, when carried daily the identification card will be lost or misplaced. It is difficult to determine the location of the identification card because it is unknown when or where it was last used. The loss of the identification card requires time and effort to replace along with the lost time of the person to work or perform their duties while replacing the identification card.

Accordingly, although great strides have been made in the area of identification cards, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
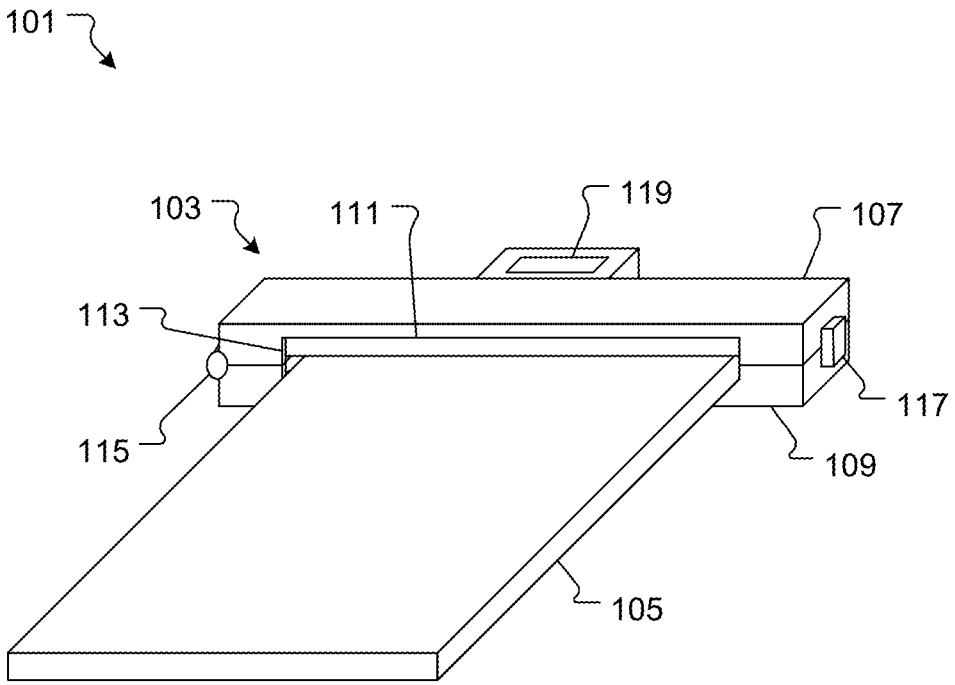
FIG. 1 is a perspective view of an identification card presentation system in accordance with a preferred embodiment of the present application.
Figure 2:
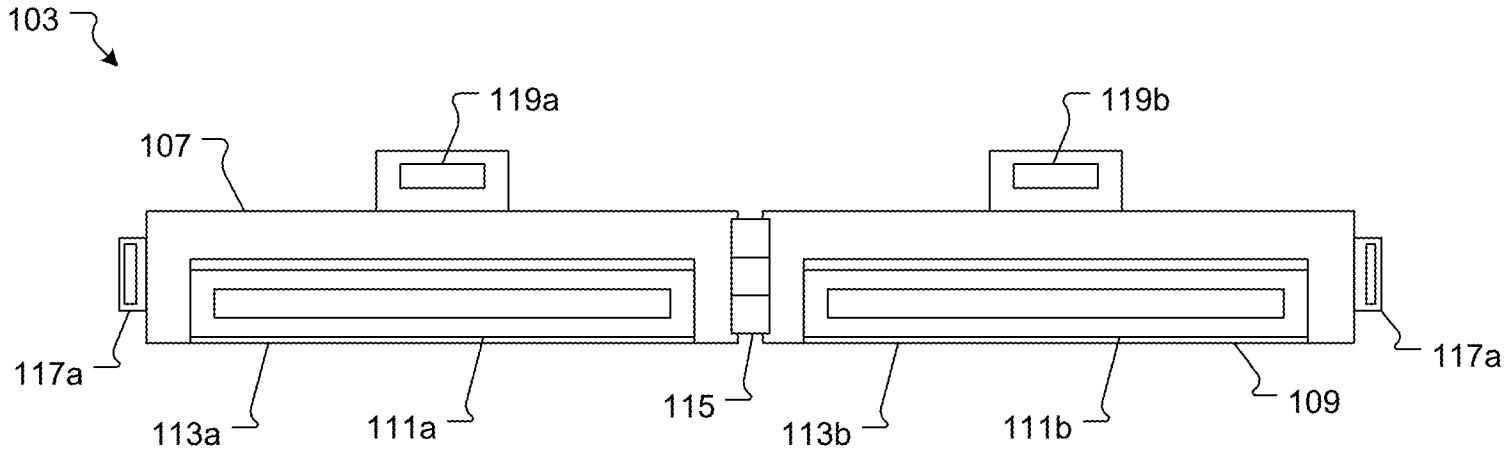
FIG. 2 is a top view of the holder of FIG. 1 open for clarity.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional identification cards. Specifically, the invention of the present application provides the means to secure an identification card to the person and allows for rapid access to the electronic key of the identification card. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a perspective view of an identification card presentation system in accordance with a preferred embodiment of the present application. It will be appreciated that system 101 overcomes one or more of the above-listed problems commonly associated with conventional identification cards.

In the contemplated embodiment, system 101 includes a holder 103 that secures an identification card 105. The holder 103 includes an upper jaw 107 and a lower jaw 109 pivotally attached via a hinge 115. Both the upper jaw 107 and lower jaw 109 have a high friction grip 111 attached within a pocket 113. The pocket 113 allows for the identification card 105 to pass between the upper jaw 107 and the lower jaw 109. The upper jaw 107 and lower jaw 109 are secured in a closed position by latch 117. The holder 103 also includes a hole 119 passing through a protrusion from the upper jaw 107 and lower jaw 109.

In use, the upper jaw 107 and lower jaw 109 are opened and the identification card 105 is placed in the pocket 113. The jaws are closed and secured via latch 117 so that the high friction grip is in positive communication with the identification card 105. The high friction grip prevents the identification card 105 from slipping or falling out of the pocket 113.

It should be appreciated that one of the unique features believed characteristic of the present application is that identification card 105 is quickly removed from the holder for presentation.

Figure 3:
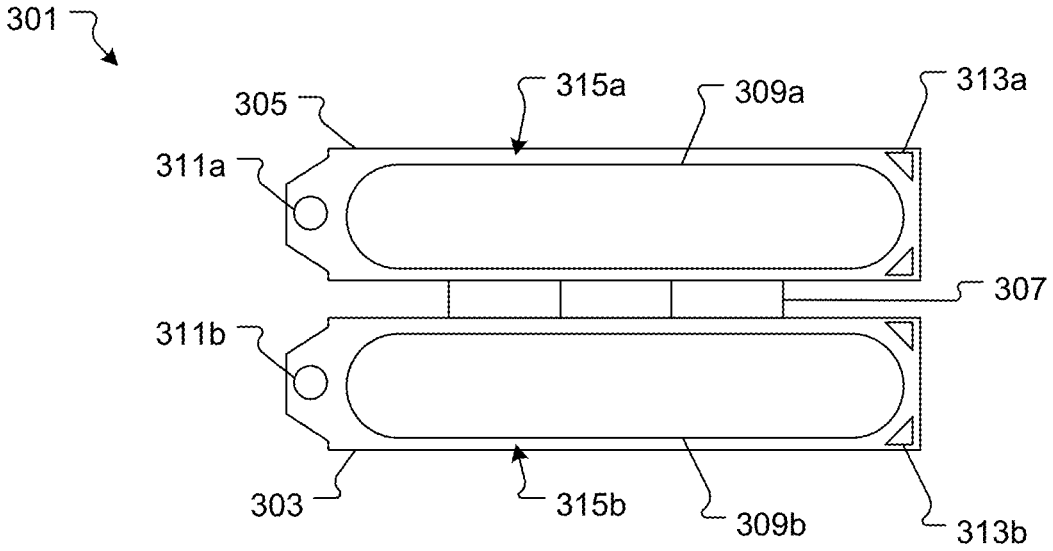
FIG. 3 is a top view of an alternative embodiment of the holder of FIG. 2.

Referring now to FIG. 3 an alternative embodiment of the holder 103 is depicted. Embodiment 301 includes an upper jaw 305 and a lower jaw 303 pivotally attached via hinge 307. In this embodiment, there is no pocket so that the identification card 105 is secured solely by the high friction grip 309 attached to the inner surfaces 315 of the upper jaw 305 and lower jaw 303. The latch 313 is configured to secure the upper jaw 305 and lower jaw 303. It is further contemplated that the embodiment 301 includes a hole 311 similar to holder 103 but in this configuration, anything that passes through the hole 311 further aids is securing the upper jaw 305 to the lower jaw 303.

Figure 4:
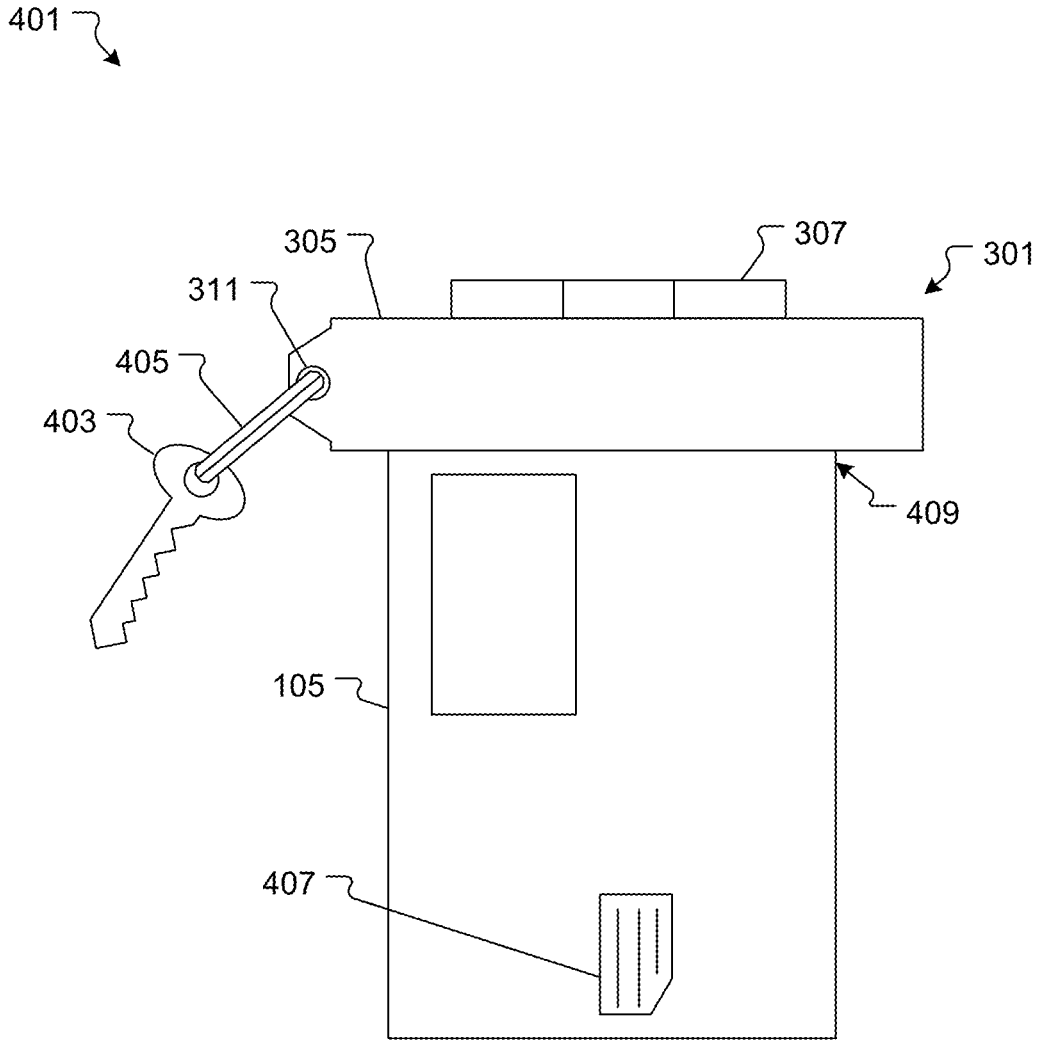
FIG. 4 is a top view of the holder of FIG. 3 in use.

As depicted by FIG. 4 the holder 301 is used to secure the identification card 105. The holder 301 has a key 403 attached thereto via a ring 405 and hole 311. It will be appreciated that with the holder at the far end 409 of the identification card 105 that the electronic key 407 is accessible without removing the identification card 105 from the holder 301.

It will be appreciated that the hole allows for a person's keys to be attached so that the person is less likely to leave a place without their identification card 105 as it is closely associated with or attached to their mode of transportation or entry to their residence.

Figure 5:
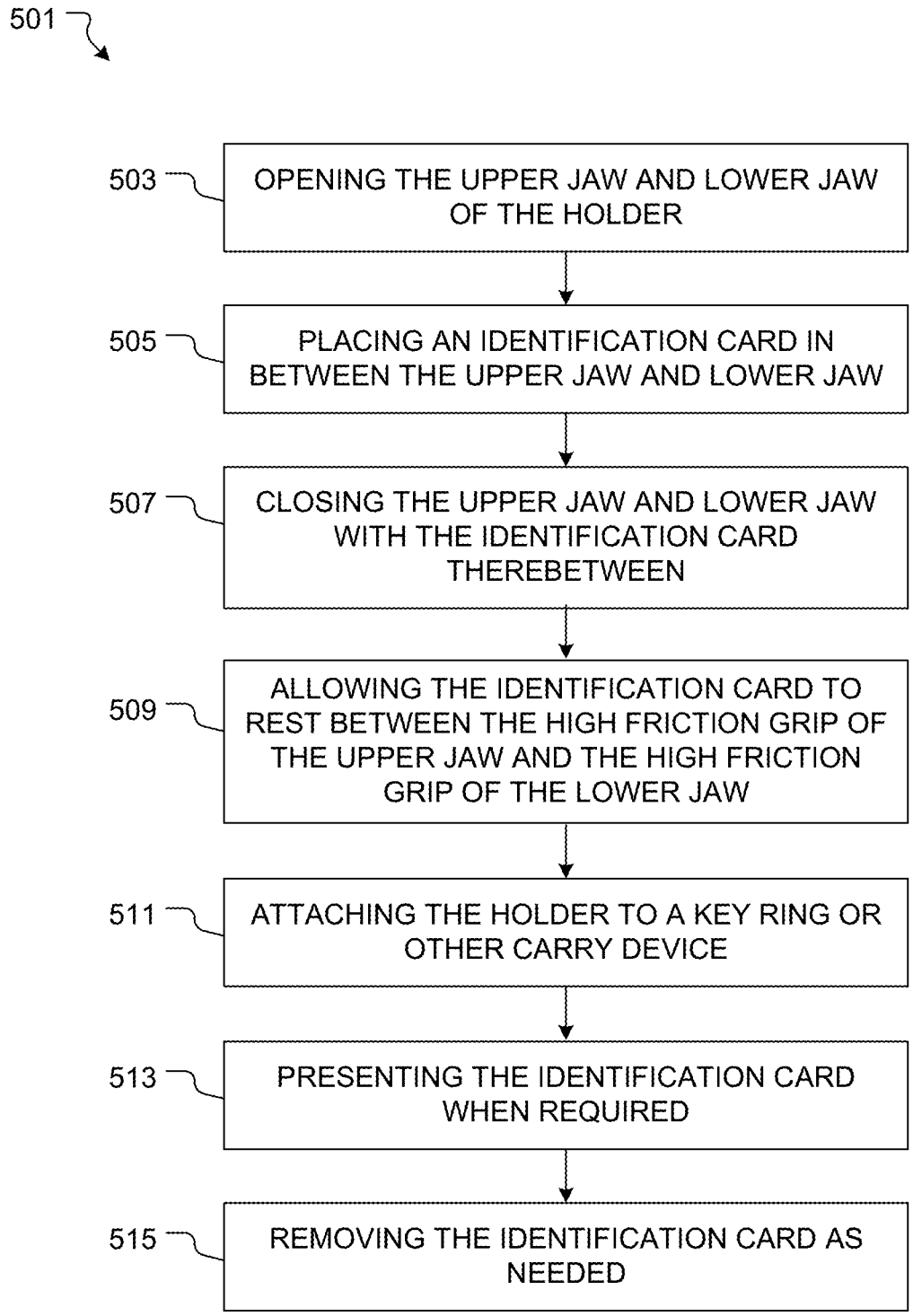
FIG. 5 is a flowchart of the preferred method of use of the system of FIG. 1.

Referring now to FIG. 5 the preferred method of use of the system 101 is depicted. Method 501 includes opening the upper jaw and lower jaw of the holder 503, placing an identification card in between the upper jaw and lower jaw 505, closing the upper jaw and lower jaw with the identification card therebetween 507, allowing the identification card to rest between the high friction grip of the upper jaw and the high friction grip of the lower jaw 509, attaching the holder to a key ring or other carry device 511, presenting the identification card when required 513 and removing the identification card as needed 515.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. An identification card presentation system comprising;

a holder that includes:

an upper jaw having a length extending from a first side end to a second side end and having a top surface and an inner surface;

a lower jaw attached to the upper jaw via a hinge at the first side end, the lower jaw extending a length equal to the length of the upper jaw;

a pocket extending from the inner surface of the upper jaw and an inner surface of the lower jaw and having a length less than the length of the upper jaw and lower jaw;

a first high friction layer attached to the inner surface of the upper jaw within the pocket;

a second high friction layer attached to an inner surface of the lower jaw, within the pocket;

a latch configures to hold the upper jaw to the lower jaw when closed; and a hole wherein a keyring is attached; and an identification card;

wherein the identification card is secured between the upper jaw and lower jaw, such that an entire top edge of the identification card is secured within the pocket; and wherein the information on the identification card is accessible while in the holder.

2. The method of carrying an identification card comprising:

providing the system of claim 1;

opening the upper jaw and lower jaw of the holder;

placing the identification card in between the upper jaw and lower jaw, such that an entire top edge of the identification card is positioned within the pocket;

closing the upper jaw and lower jaw to secure with the identification card between the upper jaw and the lower jaw and within the pocket;

presenting the identification card when required; and removing the identification card as needed.

* * * * *